United States Patent [19]

Peterson

[11] Patent Number: 5,006,087

[45] Date of Patent: Apr. 9, 1991

[54] TOWABLE INFLATABLE COVER

[76] Inventor: Leroy L. Peterson, 13614 Pierce St., Omaha, Nebr. 68144

[21] Appl. No.: 481,520

[22] Filed: Feb. 20, 1990

[51] Int. Cl.[5] ..... B63B 7/08

[52] U.S. Cl. ..... 441/66; 114/345

[58] Field of Search ..... 441/66; 114/345

[56] References Cited

U.S. PATENT DOCUMENTS

| | | | |
|---|---|---|---|
| 2,036,548 | 4/1936 | Silvernail | 441/66 |
| 4,635,581 | 1/1987 | Schearer | 441/67 |
| 4,807,554 | 2/1989 | Chi-Hung | 441/66 |

*Primary Examiner*—Sherman Basinger

*Assistant Examiner*—Thomas J. Brahan

*Attorney, Agent, or Firm*—John A. Beehner

[57] ABSTRACT

The present invention is a protective cover for an inflatable water sled having a central elongated chamber and two elongated stabilizer chambers connected to and arranged on opposite sides of the central chamber. The cover includes a flexible enclosure with opposite sides shaped to be filled by the sled's inflated central chamber. A pair of elongated side openings on opposing sides of the enclosure accommodate extension of the sled stabilizer chambers therethrough. Attached to the front of the enclosure is a tow rope fastener whereby any towing force is distributed by the enclosure across the surface area of the sled.

15 Claims, 3 Drawing Sheets

TOWABLE INFLATABLE COVER

BACKGROUND OF THE INVENTION

The present invention is directed generally to inflatable devices and more particularly to a protective cover for encapsulating an inflatable apparatus so as to allow the inflatable apparatus to be towed safely.

A popular summer recreation entails riding on inflatable sleds towed behind motor boats. These sleds usually consist of an elongated generally cylindrical shaped inflatable central chamber with a pair of opposing elongated inflatable stabilizer chambers. Such sleds are generally of a sufficient size to accommodate either one or two riders in a sitting position on top of the central chamber. Sleds of this type are manufactured by Sportsstuff, Inc., 11213 E Circle (A), Omaha, Nebr. 68137, under the trademark Propedo TM.

Since these sleds are fabricated of thermowelded gas impervious sheet materials, such as polyvinylchloride, they may be damaged by stresses inherent to towing. The areas most vulnerable to damage are at the tow rope-sled attachment points.

One solution known in the art is to attach the tow rope to the rear of the sled. This reduces the incidence of damage, but creates a hazard to riders who might become entangled in the rope while the sled is in tow. Thus, it has long been an object in the art to develop a method of preventing damage to sleds without increasing rider risk.

Accordingly, a principal object of the invention is to provide an improved apparatus and method for towing inflatable pontoon type sleds.

Another object of the invention is to provide an inexpensive apparatus and method for protecting inflatable pontoon type sleds.

Another object of the invention is to provide a cover for inflatable sleds that is easy to install.

Another object of the invention is to provide such a cover that is safe to use.

Another object of the invention is to provide such a cover that is easy to manufacture.

SUMMARY OF THE INVENTION

The present invention acts as a protective cover for an inflatable apparatus having a central elongated chamber and two elongated stabilizer chambers connected to and arranged on opposite sides of the central chamber. The cover includes a flexible enclosure with opposite sides shaped to be filled by the inflated central chamber of such a sled. Also included are a pair of elongated side openings on opposing sides of the enclosure, adapted to accommodate extension of the stabilizer chambers therethrough.

The cover may be installed by partially deflating the sled, passing the sled through one of the enclosure side openings and then re-inflating the sled within the enclosure. Fixed to the front of the enclosure is a tow means for attaching a tow rope thereby allowing any towing force to be distributed across the sled surface area.

DESCRIPTION OF THE PREFERRED EMBODIMENT

Figure 1:
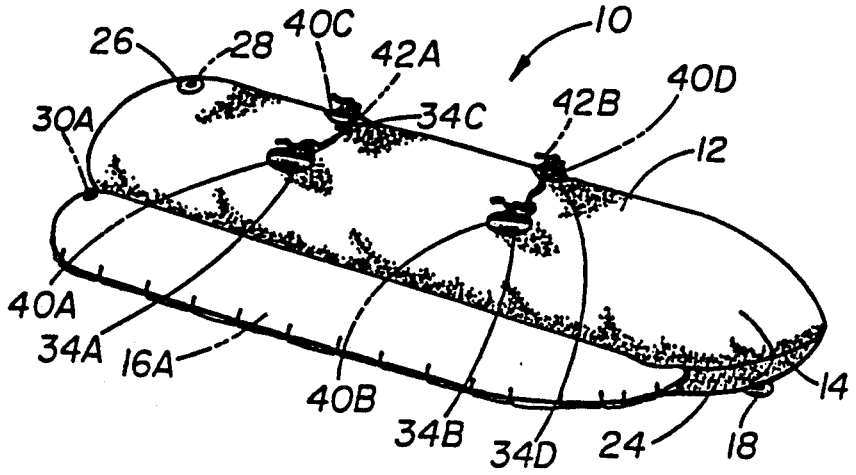
FIG. 1 is a perspective view of a preferred embodiment of the invention installed on an inflatable pontoon sled.

A preferred embodiment of the towable cover for inflatables is illustrated and described in FIGS. 1–7.

Inflatable pontoon sleds 44 (shown in FIG. 2 partially deflated) are popular instruments of summer recreation. These sleds 44 are commonly pulled behind motor boats. Because sleds 44 cf this type are generally fabricated of thermowelded sheets of polyvinylchloride they are susceptible to damage from the extreme stresses inherent to towing.

The cover 10 includes a flexible enclosure formed of a durable rip resistant synthetic fabric such as a nylon sheet material. The flexible enclosure is adapted to be filled by the central chamber of an inflatable sled 44, and is formed of a top sheet 12 and a bottom sheet 24, having front and back side edges folded together and sewn to form front and back seams 14.

In order that the left and right stabilizer chambers 16A and 16B of a sled 44 may extend outside of the flexible enclosure, left and right stabilizer openings 32A and 32B are provided. So that the fabric of the flexible enclosure does not fray around the boundaries of the stabilizer openings 32A and 32B the edges may be folded over and sewn or glued.

Attached to the front of the bottom sheet 24 (FIGS. 3 and 6) by an H-shaped strap 22 is a D-shaped ring 18. A rope may be tied to the ring 18 so that a sled 44 within the enclosure 10 may be safely towed. The H-shaped strap 22 may be glued and sewn to the bottom sheet 24, and may otherwise be reinforced by any method known to the art.

So that the keel 20 (FIG. 4) of the sled 44 may perform its function while the apparatus 10 is installed on a sled 44, a pair of keel openings 36 (FIG. 6) are provided in the bottom sheet 24.

A plurality of hand hold openings 34A, 34B, 340, and 34D may be provided in the top sheet of the flexible enclosure 10 so that the hand holds 40A, 40B, 40C, and 40D of the sled 44 may protrude from the enclosure 10. In this manner the hand holds may be utilized while the enclosure 10 is installed on a sled 44.

Figure 2:
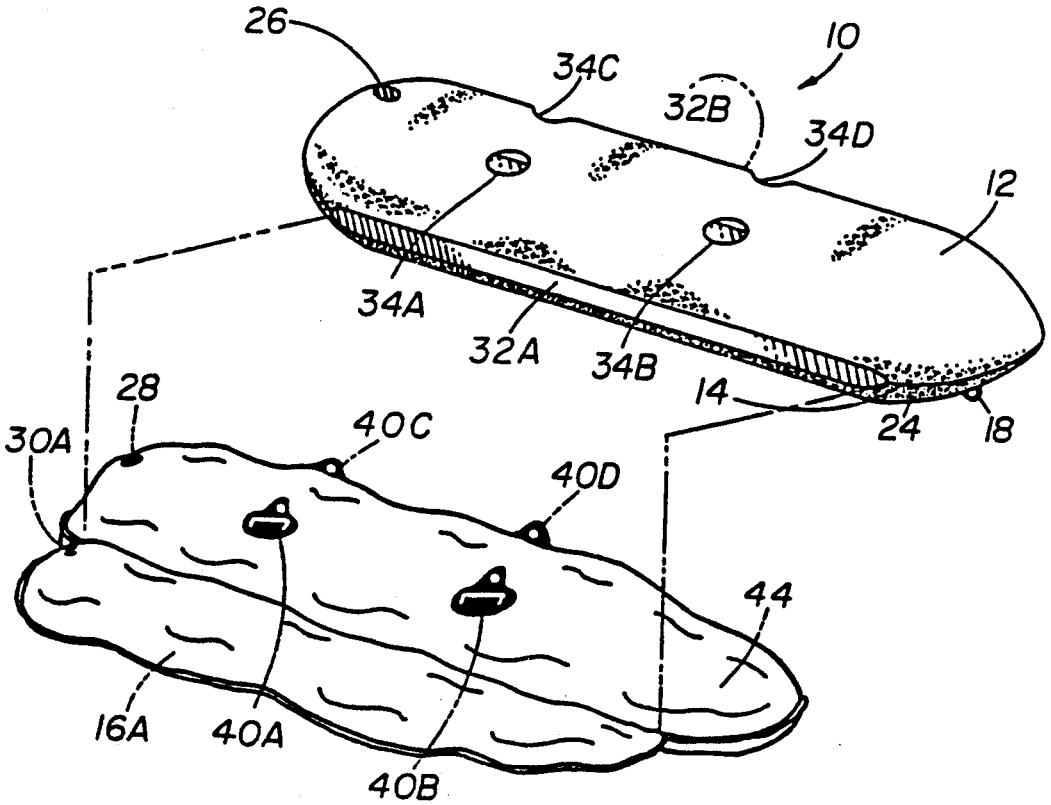
FIG. 2 is an exploded perspective view of the invention and a partially deflated pontoon sled prepared for installation by passing the sled through one of the opposing side openings of the flexible enclosure.
Figure 5:
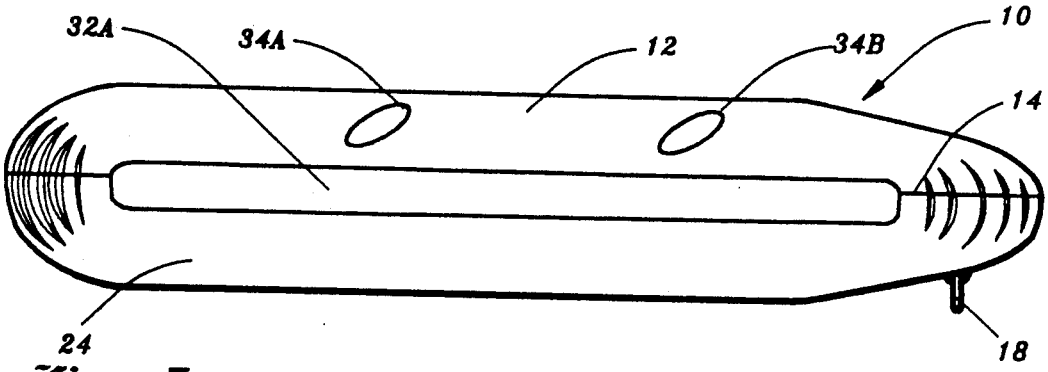
FIG. 5 is a side view of the invention showing the side and hand hold openings.
Figure 6:
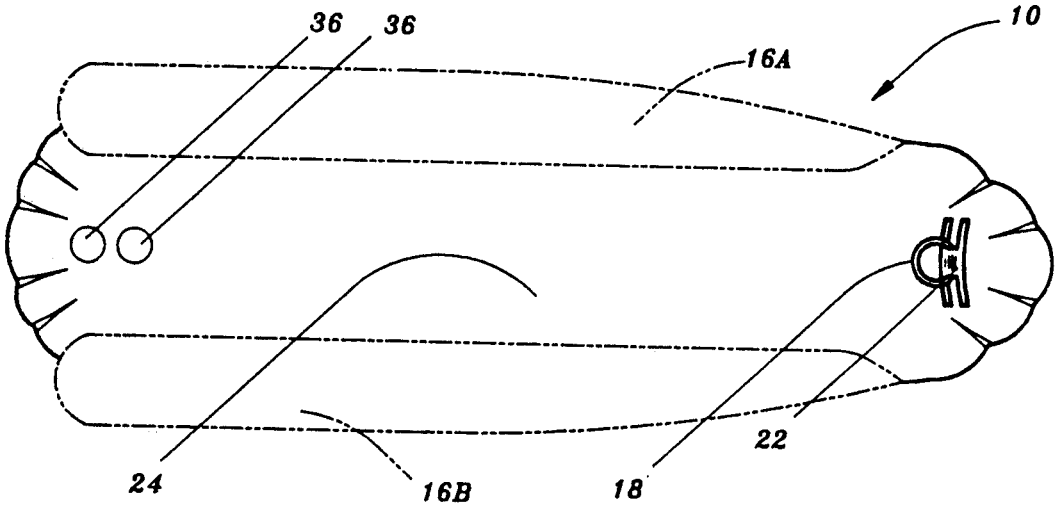
FIG. 6 is a bottom plan view of the invention showing the towing means and relative position of the two sled stabilizer chambers.
Figure 7:
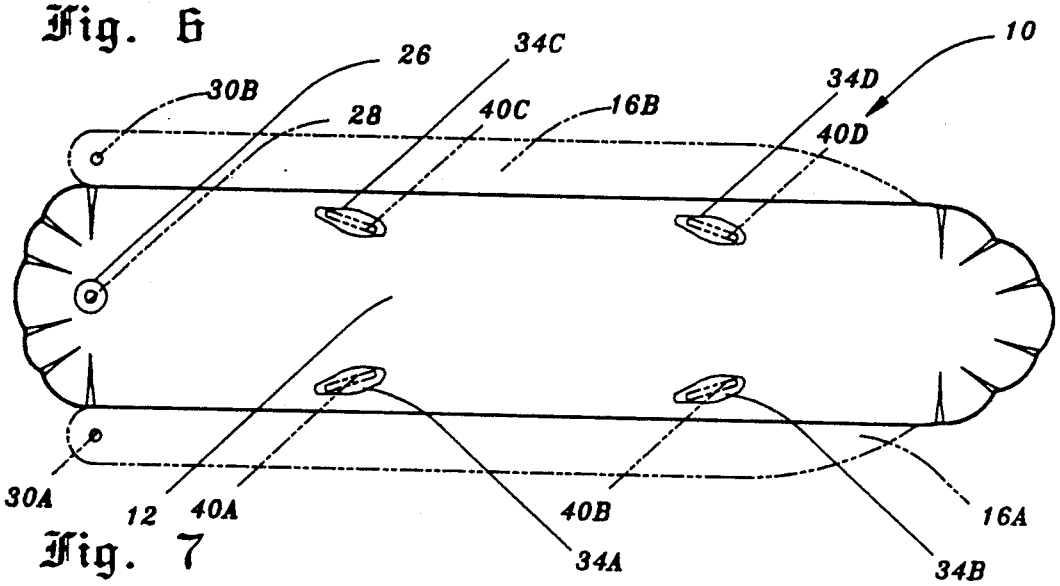
FIG. 7 is a top plan view of the invention showing the plug and hand hold openings and relative position of the two sled stabilizer chambers.
Figure 3:
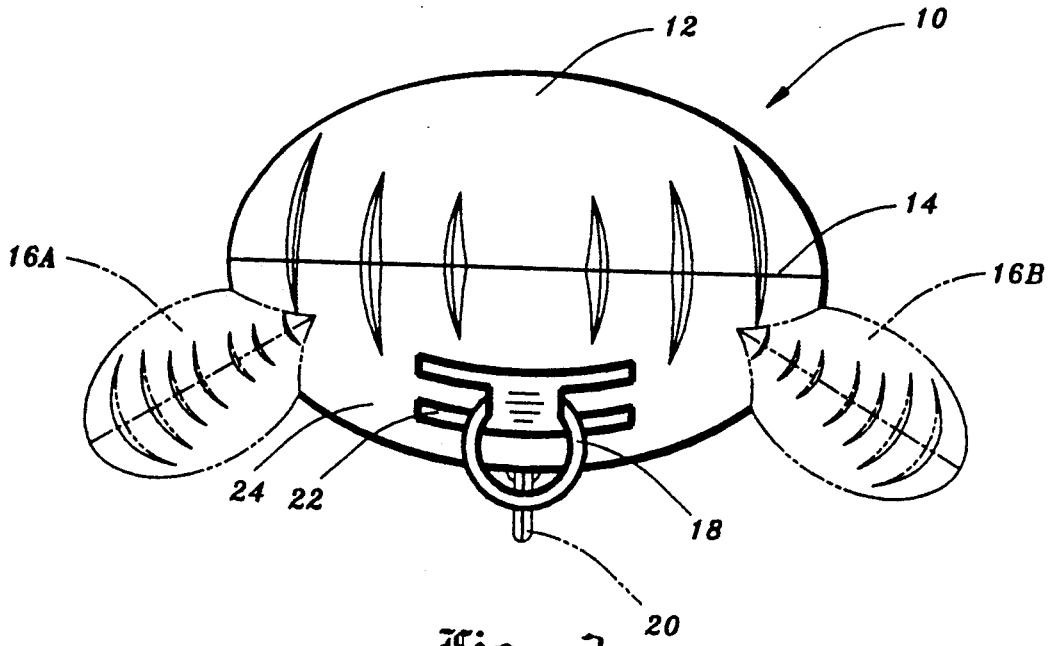
FIG. 3 is a front elevational view of the invention installed onto a sled showing a D-shaped ring towing means.
Figure 4:
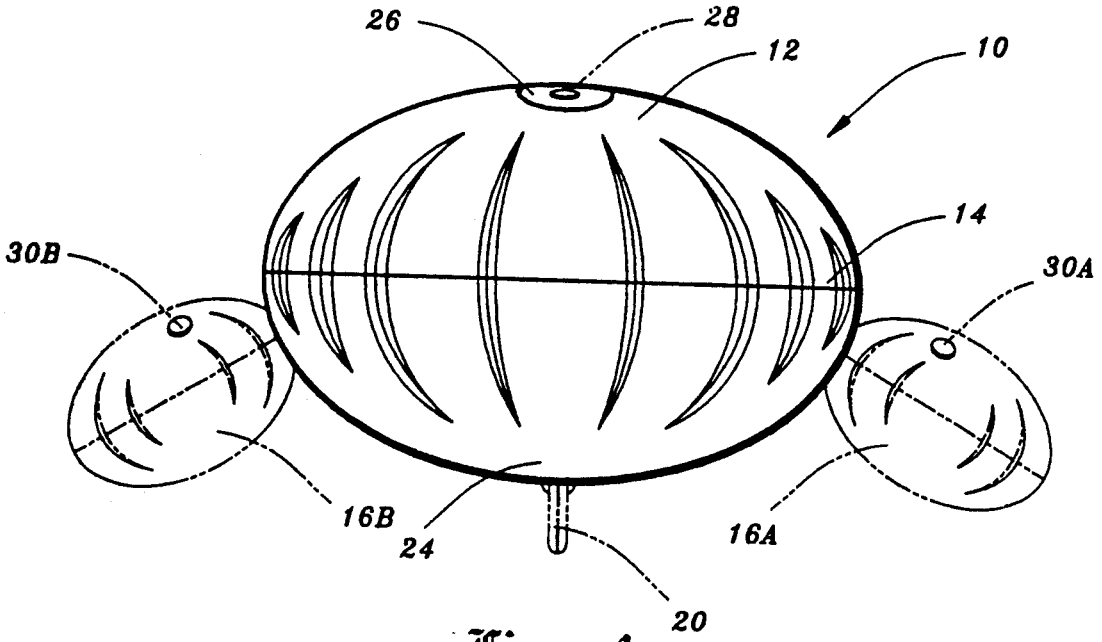
FIG. 4 is a back view of the invention showing the keel and plug openings.

The keel 20 may be removed from the sled 44 and the sled may be partially deflated by allowing air to escape from the central chamber plug 28, and left and right stabilizer chamber plugs 30A and 30B (FIG. 2). Once the sled 44 is partially deflated it may be passed through one of the flexible enclosure stabilizer chamber openings 32A or 32B, so that the central chamber of the sled 44 is inside the enclosure, and the left and right stabilizer chambers 16A and 16B protrude from the left and right stabilizer chamber openings 32A and 32B respectively. The keel 20 may then be reinserted into the keel openings 36. Two short lengths of rope 42A and 42B may then be tied between the hand handles 40D and 40B, and 40C and 40A respectively so as to create hand handles for both a front and back passenger on the sled 44. Once the sled 44 is re-inflated through the plugs 28, 30A and 30B, the sled and cover assembly may be towed via the D-shaped ring 18.

For maximum enjoyment over a long period of use, it is important that the inflatable sled is capable of being towed at relatively high speeds over choppy water and across waves without rupturing the fabric of the inflatable sled. The cover of the present invention distributes the towing force from the tow rope across a substantial area of the sled surface for minimum stress at any given point on the sled. The tendency of the cover to vertically and transversely collapse when pulled from the front actually affords structural reinforcement for the sled as it is towed. The cover eliminates the need for tow ropes to extend rearwardly behind the front of the sled thereby eliminating the danger of a rider or foreign object getting caught in such ropes. The cover of the invention will thus prolong the useful life of the sled and increase the safety and enjoyment of users.

Whereas, the dimensions of the enclosure are not critical to the invention, a preferred embodiment is of a size to accommodate the central chambers of pontoon type inflatable sleds.

Whereas, the material from which the apparatus is formed is not critical to the invention, a preferred embodiment may be fabricated from nylon sheet, or other durable rip resistant fabrics.

Whereas, the invention has been described in connection with a preferred embodiment thereof, it is apparent that many additions, modifications and substitutions may be made which are within the intended broad scope of the appended claims.

Thus, there has been shown and described an improved artificial apparatus which accomplishes at least all of the stated objects.

I claim:

1. A protective cover for an inflatable apparatus having a central elongated chamber and two elongated stabilizer chambers connected to and arranged on opposite sides of said central chamber, said protective cover comprising a flexible enclosure having opposite sides and shaped to conform to and be substantially filled by the inflated central chamber of said inflatable apparatus, said enclosure having a pair of elongated side openings on respective opposite sides thereof, each side opening being of such size and position to accommodate extension of a stabilizer chamber therethrough upon insertion of an at least partially deflated inflatable apparatus through one of said side openings and upon inflation of said apparatus within the enclosure, and tow means for attaching a tow rope to said flexible enclosure whereby towing force is distributed by said enclosure across a substantial surface area of the inflatable apparatus to minimize stress on said inflatable apparatus.

2. The cover of claim 1 wherein said side openings are substantially filled by said elongated stabilizer chambers.

3. The cover of claim 1 wherein said inflatable apparatus has a plurality of hand holds and said cover further comprising a plurality of hand hold openings in said flexible enclosure positioned for registration with said hand holds whereby said plurality of hand holds may protrude through said plurality of hand hold openings in said flexible enclosure.

4. The cover of claim 1 wherein said inflatable apparatus has a keel and said cover further comprising a keel opening in said flexible enclosure positioned for registration with said keel whereby said keel may protrude through said opening keel in said flexible enclosure.

5. The cover of claim 1 wherein said inflatable apparatus has a plug means for inflating and deflating said central chamber of said inflatable apparatus and said cover further comprising a plug opening in said flexible enclosure positioned for registration with said plug whereby said plug may be accessed through said plug opening in said flexible enclosure.

6. The cover of claim 1 wherein said tow means comprises a rigid generally D-shaped member and means for attaching said D-shaped member to said enclosure.

7. The cover of claim 6 wherein said D-shaped member is formed of a durable and stainless material.

8. The cover of claim 6 wherein said means for attaching said D-shaped member to said enclosure comprises a generally H-shaped strap having a pair of vertical bars attached to said flexible enclosure, and a horizontal bar connected to and extending between said vertical bars and passing through said generally D-shaped member.

9. The cover of claim 1 wherein said flexible enclosure further comprises, a front portion, a back portion, a top portion, and a bottom portion.

10. The cover of claim 9 wherein said tow means is connected to the front portion of said flexible enclosure.

11. The cover of claim 1 wherein said flexible enclosure is formed of a synthetic fabric.

12. The cover of claim 11 wherein said synthetic fabric is resistant to ripping.

13. The cover of claim 11 wherein said synthetic fabric is nylon.

14. The cover of claim 11 wherein said synthetic fabric is polyester.

15. The cover of claim 11 wherein said synthetic fabric is dacron.

* * * * *